US011448149B2

(12) United States Patent
Wirkowski et al.

(10) Patent No.: US 11,448,149 B2
(45) Date of Patent: Sep. 20, 2022

(54) METHOD AND DEVICE FOR PREDICTING THE FAILURE TIME OF THE PRESSURE LIMITING VALVE OF A HIGH-PRESSURE FUEL PUMP OF A MOTOR VEHICLE

(71) Applicant: Vitesco Technologies GMBH, Hannover (DE)

(72) Inventors: Michael Wirkowski, Regensburg (DE); Tobias Ritsch, Regensburg (DE); Claus Stephani, Pfatter (DE)

(73) Assignee: Vitesco Technologies GmbH, Regensburg (DE)

( * ) Notice: Subject to any disclaimer, the term of this patent is extended or adjusted under 35 U.S.C. 154(b) by 0 days.

(21) Appl. No.: 16/898,975

(22) Filed: Jun. 11, 2020

(65) Prior Publication Data

US 2020/0309052 A1 Oct. 1, 2020

Related U.S. Application Data

(63) Continuation of application No. PCT/EP2018/083782, filed on Dec. 6, 2018.

(51) Int. Cl.
*F02D 28/00* (2006.01)
*F02D 41/14* (2006.01)
(Continued)

(52) U.S. Cl.
CPC ..... *F02D 41/1401* (2013.01); *F02D 41/221* (2013.01); *F02M 59/46* (2013.01);
(Continued)

(58) Field of Classification Search
CPC ..... F02D 2200/0602; F02D 2041/224; F02D 2041/225; F02D 2041/1412; F02D 41/1401; F02D 41/221; F02M 59/46; F02M 63/005
See application file for complete search history.

(56) References Cited

U.S. PATENT DOCUMENTS

2006/0215740 A1 12/2006 Teruuchi
2007/0079808 A1* 4/2007 Takahashi ..... F02M 63/025 123/447
(Continued)

FOREIGN PATENT DOCUMENTS

CN 102812226 A 12/2012
CN 103635677 A 3/2014
(Continued)

OTHER PUBLICATIONS

International Search Report and Written Opinion dated Mar. 15, 2019 from corresponding International Patent Application No. PCT/EP2018/083782.
(Continued)

*Primary Examiner* — Gonzalo Laguarda

(57) ABSTRACT

Disclosed is a method and a device for predicting the failure time of the pressure limiting valve of a high-pressure fuel pump of a motor vehicle. The method includes measuring a characteristic parameter of the pressure limiting valve each time the motor vehicle has been switched off, determining and storing a variable determined by using the measured characteristic parameter, determining the time profile of the variable determined from the characteristic parameter, predicting the future profile of the variable determined from the characteristic parameter, and comparing the predicted future profile of the variable determined from the characteristic parameter with a predetermined wear limiting value. The comparison is to predict the time at which the predicted future profile of the variable determined from the characteristic parameter reaches the predetermined wear limiting value.

16 Claims, 2 Drawing Sheets

(51) Int. Cl.
*F02D 41/22* (2006.01)
*F02M 59/46* (2006.01)
*F02M 63/00* (2006.01)

(52) U.S. Cl.
CPC ... *F02M 63/005* (2013.01); *F02D 2041/1412* (2013.01); *F02D 2041/224* (2013.01); *F02D 2200/0602* (2013.01)

(56) References Cited

U.S. PATENT DOCUMENTS

| | | | | |
|---|---|---|---|---|
| 2013/0013174 | A1* | 1/2013 | Nistler | F02M 59/366 701/112 |
| 2013/0013175 | A1* | 1/2013 | Nistler | F02D 41/22 701/112 |
| 2013/0019670 | A1 | 1/2013 | Jung | |
| 2014/0123950 | A1 | 5/2014 | Doelker et al. | |
| 2015/0167611 | A1 | 8/2015 | Schulz | |
| 2017/0211504 | A1 | 7/2017 | Klesse et al. | |
| 2018/0195458 | A1* | 7/2018 | Puckett | F02D 41/3082 |

FOREIGN PATENT DOCUMENTS

| | | | |
|---|---|---|---|
| CN | 104583577 | A | 4/2015 |
| CN | 105937454 | A | 9/2016 |
| DE | 102004005851 | A1 | 9/2005 |
| DE | 102011001877 | A1 | 10/2012 |
| DE | 102011100187 | B3 | 11/2012 |
| DE | 102012214635 | A1 | 2/2014 |
| DE | 102012021428 | A1 | 4/2014 |
| DE | 102014220742 | A1 | 4/2016 |
| JP | H05272425 | | 10/1993 |
| JP | 2001032724 | A | 2/2001 |
| JP | 2003106166 | A | 4/2003 |
| JP | 2006270510 | A | 10/2006 |
| JP | 2009270510 | A | 11/2009 |
| JP | 2009270511 | A | 11/2009 |
| KR | 20140033380 | A | 3/2014 |
| KR | 201700127108 | A | 11/2017 |
| WO | 2017092972 | A1 | 6/2017 |

OTHER PUBLICATIONS

German Office Action, dated Jan. 2, 2019, for counterpart DE application 102017222559.9.
Korean Notice of Allowance dated Sep. 8, 2021 for corresponding Korean Patent Application No. 10-2020-7020087.
Chinese Office Action dated Jun. 25, 2021 for corresponding Patent Application No. 201880080422.0.
Korean Office Action dated Mar. 31, 2021 for corresponding Korean Patent Application No. 10-2020-7020087.

* cited by examiner

METHOD AND DEVICE FOR PREDICTING THE FAILURE TIME OF THE PRESSURE LIMITING VALVE OF A HIGH-PRESSURE FUEL PUMP OF A MOTOR VEHICLE

CROSS REFERENCE TO RELATED APPLICATIONS

This application claims the benefit of PCT Application PCT/EP2018/083782, filed Dec. 6, 2018, which claims priority to German Application DE 10 2017 222 559.9, filed Dec. 13, 2017. The above applications are incorporated herein by reference.

FIELD OF INVENTION

The invention relates to a method and to a device for predicting the failure time of the pressure limiting valve of a high-pressure fuel pump of a motor vehicle.

BACKGROUND

In fuel injection systems which inject fuel under high pressure into the combustion chamber of an internal combustion engine, the required high pressure is produced using a high-pressure fuel pump. A high-pressure fuel pump of this kind is generally fitted with a pressure relief valve to ensure that a pressure reduction takes place via said pressure relief valve in the case where there is an impermissibly high pressure. The pressure relief valve assumes the functions of limiting the fuel pressure in the high-pressure region to a value at which it is certain that the high-pressure region will not leak and at which it is furthermore also certain that the injectors supplied with high-pressure fuel will still be able to inject the fuel into the combustion chamber. These are generally capable of opening against the high pressure only up to a certain maximum pressure.

This pressure limitation is significant for the two following cases:

a. A high-pressure pump can no longer be controlled owing to a malfunction and, instead of delivering a predetermined fuel quantity, incorrectly delivers an excessive fuel quantity or even the maximum possible fuel quantity into the high-pressure region.

b. After the internal combustion engine has been stopped, the high-pressure region of the internal combustion engine is heated by waste heat from the engine. Here, the degree of heating depends on the engine temperature and the fuel temperature and differs in practice. In the case of a high degree of heating, the pressure in the high-pressure region, which is hermetically sealed, rises.

To ensure that the pressure limited by the pressure limiting valve is as low as possible in order to ensure the opening of the injectors, the pressure limiting valve is set in such a way that it opens at this pressure and discharges the fuel from the high-pressure region of the system into the low-pressure region of the internal combustion engine.

During normal operation of the internal combustion engine, pressure peaks that briefly open the pressure limiting valve may also occur in the event of special operating points, especially at a high load and/or high engine speeds.

Consequently, the pressure limiting valve is also used, i.e. opened and closed, during the normal operation of the internal combustion engine. The opening of the pressure limiting valve, in particular, causes increasing wear of the pressure limiting valve. If the wear is too great, the pressure limiting valve begins to leak. In this case, adequate engine starting is no longer possible. In extreme cases, engine starting is no longer even possible.

The practice of replacing a worn pressure limiting valve or the entire high-pressure fuel pump if the engine can no longer be started or can be started only significantly less well than normal is already known. For this purpose, it is necessary to bring the vehicle to a repair garage on a date especially set for this replacement.

Furthermore, it may also happen that the vehicle can no longer be started after a pause during a relatively long journey, thus making it necessary to tow the vehicle away and to make an unplanned visit to a repair garage.

Moreover, the practice of replacing the pressure limiting valve or the entire high-pressure fuel pump as a precaution after a predetermined operating time is already known.

There is furthermore already a known practice of lengthening the service life of a pressure limiting valve by setting the pressure so high that the pressure limiting valve does not open during normal operation at infrequently occurring operating points with high pressure peaks or that opening of the pressure limiting valve caused by pressure peaks is prevented by the level of the set pressure, e.g. at a pressure of 60 bar above the nominal pressure of, for example, 250 bar. However, this procedure has the disadvantage in the design of the system that the injectors must likewise withstand at least such high pressures and must furthermore be able to inject even at the high opening pressure of the pressure limiting valve, and that the magnetic circuit must be designed for correspondingly high pressures. This is associated with high component costs for the injectors.

SUMMARY

It is an object to specify a method and a device by means of which better availability of the high-pressure pump and hence of the vehicle in which the high-pressure pump is installed is achieved.

The advantages of the example embodiments, in particular, may be in that, by virtue of the evaluation of the relationships between the time profile of characteristic wear features of the pressure limiting valve and the time interval until a wear-related failure of the high-pressure fuel pump, the repair behavior, reliability and type of design of high-pressure fuel pumps may be modified in a positive way. The monitoring of the characteristic wear features, the collecting of associated data and the correct interpretation of these data lead to the possibility of predicting the time of a wear-related failure of the pressure limiting valve and hence of the high-pressure fuel pump and thereby of enhancing the robustness of the engine, the reliability and availability of the motor vehicle while simultaneously reducing unforeseen repair garage times and unforeseen demand for resources.

Furthermore, the maximum opening pressure of the pressure limiting valve may be set to a lower level without risking vehicle breakdowns or vehicles becoming immobilized. The solenoid valves or injectors may be of less expensive construction since the magnetic circuit has to open against lower pressures, and the solenoid valves or injectors are exposed to lower pressures. This results, inter alia, in a different, less expensive choice of materials.

BRIEF DESCRIPTION OF THE DRAWINGS

Further advantageous characteristics of the invention will emerge from the exemplary explanation thereof below on the basis of the figures. In the figures.

DETAILED DESCRIPTION

The example embodiments provide a method for predicting the failure time of the pressure limiting valve of a high-pressure fuel pump of a motor vehicle, with the method having the following method actions:

i. measuring a characteristic parameter of the pressure limiting valve each time the motor vehicle has been switched off, ii. determining and storing a variable determined from the measured characteristic parameter, iii. determining the time profile of the variable determined from the characteristic parameter, iv. predicting the future profile of the variable determined from the characteristic parameter, and v. comparing the predicted future profile of the variable determined from the characteristic parameter with a predetermined wear limiting value to predict the time at which the predicted time profile of the variable determined from the characteristic parameter reaches the predetermined wear limiting value.

This last mentioned time is predicted as the failure time of the pressure limiting valve of the high-pressure fuel pump of a motor vehicle and may be indicated to the driver of the motor vehicle and/or to the repair garage personnel automatically or after being called up.

This makes it possible for the driver of the motor vehicle to make provision for a repair or replacement of the pressure limiting valve or of the entire high-pressure fuel pump in good time before a vehicle breakdown due to a wear-related failure of the pressure limiting valve. The probability of an unexpected vehicle breakdown due to a wear-related failure of the pressure limiting valve is greatly reduced.

The characteristic parameter specified herein for the pressure limiting valve is preferably the pressure prevailing at the pressure limiting valve, as will be apparent from the following explanation of the figures.

Figure 1:
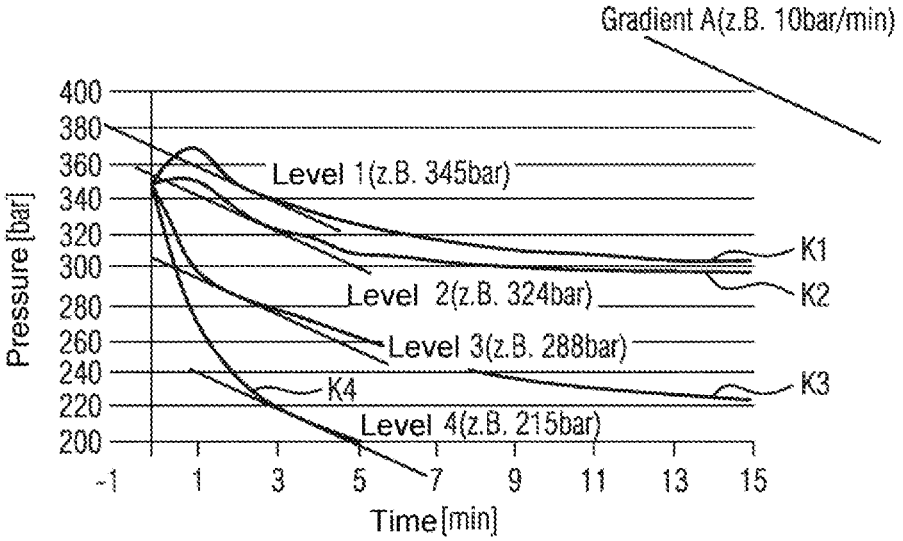
FIG. 1 shows a first diagram, for predicting the wear-related failure time of the pressure limiting valve of the high-pressure fuel pump of a motor vehicle.

FIG. 1 shows a first diagram, which may be used in predicting the wear-related failure time of the pressure limiting valve of the high-pressure fuel pump of a motor vehicle. In this first diagram, the pressure is plotted toward the top in bar and the time is plotted toward the right in minutes. Curve K1 characterizes the behavior of a pressure limiting valve that has been newly put into operation. Curve K2 characterizes the behavior of a pressure limiting valve that has already been put into operation and is still fully leaktight. Curve K3 characterizes the behavior of a pressure limiting valve that is already worn and is no longer fully leaktight. Curve K4 characterizes the behavior of a pressure limiting valve that is already faulty.

To generate these curves, a characteristic parameter of the pressure limiting valve is measured after the motor vehicle has been switched off, this characteristic parameter being the pressure prevailing in the high-pressure region at the pressure limiting valve. From curves K1 and K2, it may be seen that, in the case of a new pressure limiting valve or of a pressure limiting valve which is no longer new but still has normal leaktightness, there is initially a brief pressure rise in the high-pressure region of the motor vehicle in the context of a short afterheating phase after the motor vehicle has been switched off, and that a pressure drop extending over time occurs after this brief pressure rise. From curves K3 and K4, it may be seen that, in the case of a pressure limiting valve which is already worn or of a pressure limiting valve which is already faulty, a more pronounced pressure drop extending over time occurs right from the beginning after the motor vehicle has been switched off.

This pressure profile after the engine has been switched off characterizes the degree of wear of the pressure limiting valve and, after further evaluation of this pressure loss, allows a prediction of the time of the wear-related failure of the pressure limiting valve. For this purpose, the pressure may be measured after each shutdown of the engine, and the pressure difference is determined and stored as the relevant variable associated with the respective pressure drop. The time profile of this stored variable, plotted against the number of operating hours, allows a prediction on the time of the wear-related failure of the pressure limiting valve and hence also on the residual life that may be expected from the pressure limiting valve.

In FIG. 1, it can be seen that the pressure loss which occurs after the engine is switched off is a measure of the wear of the pressure limiting valve. The pressure level at which a particular pressure gradient, measured in bar per minute, occurs is a value which becomes smaller with increasing wear of the pressure limiting valve. This value is determined using the measured pressure values. As has already been explained above, the pressure loss curves for various degrees of wear of the pressure limiting valve are illustrated in FIG. 1. It can be seen that the gradient value, in this case 10 bar per minute for example, is at a lower pressure level with increasing wear of the pressure limiting valve. If this pressure level at which the predetermined pressure gradient occurs is tracked over the number of operating hours, the further profile may be predicted by means of a trend analysis. By comparing this further profile with a predetermined wear limit, the time at which the wear limit is reached may be predicted.

Figure 2:
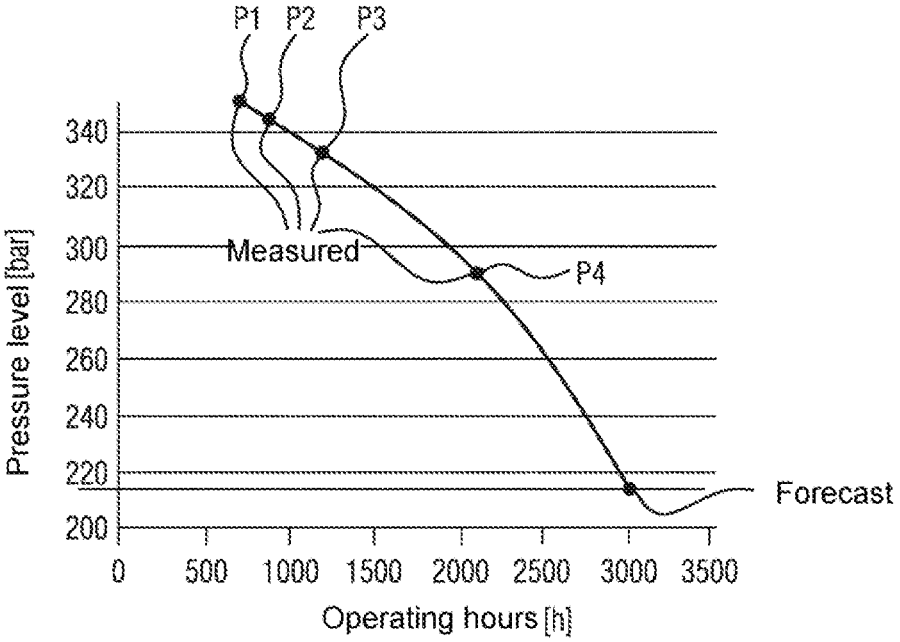
FIG. 2 shows a second diagram, for predicting the wear-related failure time of the pressure limiting valve of the high-pressure fuel pump of a motor vehicle.

This is illustrated in FIG. 2. FIG. 2 shows a second diagram, which may be used in predicting the wear-related failure time of the pressure limiting valve of the high-pressure fuel pump of a motor vehicle. In this second diagram, the pressure level is plotted toward the top in bar and the operating time of the pressure limiting valve is plotted toward the right in operating hours.

The pressure level denoted by P1 was determined after 700 operating hours. The pressure level denoted by P2 was determined after 900 operating hours. The pressure level denoted by P3 was determined after 1200 operating hours. The pressure level denoted by P4 was determined after 2100 operating hours. From the profile of the pressure levels determined it is possible to predict the time at which a wear-related failure of the pressure limiting valve may be expected. In the case of the illustrative embodiment illustrated in FIG. 2, this is the case after 3000 operating hours.

By virtue of this prediction, the driver of the motor vehicle has the possibility of making provision for a repair or replacement of the pressure limiting valve or of the entire high-pressure fuel pump in good time before the predicted failure of the pressure limiting valve.

Figure 3:
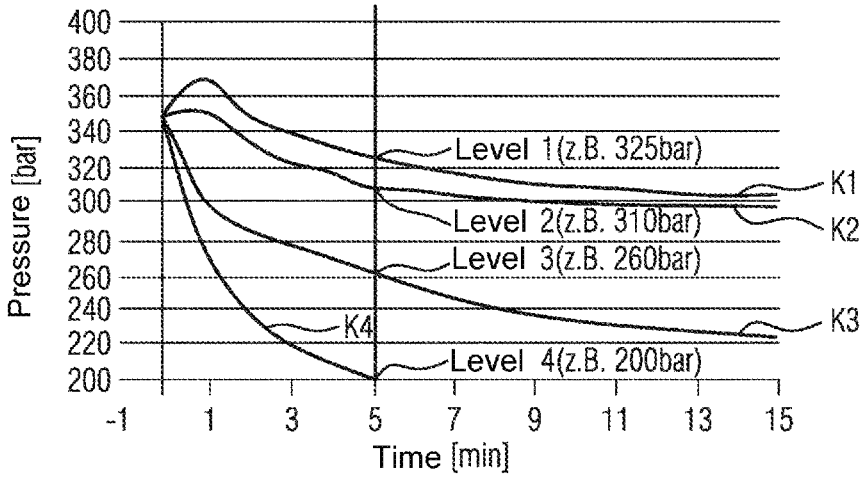
FIG. 3 shows a third diagram, for predicting the wear-related failure time of the pressure limiting valve of the high-pressure fuel pump of a motor vehicle.

FIG. 3 shows a third diagram, which may be used in predicting the wear-related failure time of the pressure limiting valve of the high-pressure fuel pump of a motor vehicle, instead of the first diagram shown in FIG. 1.

In this third diagram, the pressure is plotted toward the top in bar and the time is plotted toward the right in minutes. Curve K1 characterizes the behavior of a pressure limiting valve that has been newly put into operation. Curve K2 characterizes the behavior of a pressure limiting valve that has already been put into operation and is still fully leaktight. Curve K3 characterizes the behavior of a pressure limiting valve that is already worn and is no longer fully leaktight. Curve K4 characterizes the behavior of a pressure limiting valve that is already faulty.

To generate these curves, a characteristic parameter of the pressure limiting valve is measured after the motor vehicle has been switched off, this characteristic parameter being the pressure prevailing in the high-pressure region at the pressure limiting valve. From curves K1 and K2, it can be seen that, in the case of a new pressure limiting valve or of a pressure limiting valve which is no longer new but still has normal leaktightness, there is initially a brief pressure rise in the high-pressure region of the motor vehicle in the context of a short afterheating phase after the motor vehicle has been switched off, and that a pressure drop extending over time occurs after this brief pressure rise. From curves K3 and K4, it can be seen that, in the case of a pressure limiting valve which is already worn or of a pressure limiting valve which is already faulty, a more pronounced pressure drop extending over time occurs right from the beginning after the motor vehicle has been switched off.

This pressure profile after the engine has been switched off characterizes the degree of wear of the pressure limiting valve and, after further evaluation of this pressure loss, allows a prediction of the time of the wear-related failure of the pressure limiting valve. For this purpose, the pressure drop may be measured each time the engine is switched off, and the pressure difference is stored as the relevant variable associated with the respective pressure drop and determined from the respective pressure. The time profile of this stored variable, plotted against the number of operating hours, allows a prediction on the time of the wear-related failure of the pressure limiting valve and hence also on the residual life that may be expected from the pressure limiting valve.

In FIG. 3, it can be seen that the pressure loss which occurs after the engine is switched off is a measure of the wear of the pressure limiting valve.

In the case of the illustrative embodiment shown in FIG. 3, the pressure over time prevailing at the pressure limiting valve in the high-pressure region is measured after the engine has been switched off. After a predetermined period of time, this pressure has reached a different, lower pressure level depending on the degree of wear of the pressure control valve.

In the illustrative embodiment shown in FIG. 3, the predetermined period of time is 5 minutes. After this period of time, the pressure level of curve K1 is 325 bar, the pressure level of curve K2 is 310 bar, the pressure level of curve K3 is 260 bar and the pressure level of curve K4 is 200 bar.

If this pressure level established after the defined time is determined for the further service life of the pressure limiting valve, in each case after the engine has been switched off, and is stored, the further profile of the wear-related pressure loss curve may be predicted by means of a trend analysis, from which, in turn, the time of a wear-related failure of the pressure control valve may be predicted.

Figure 4:
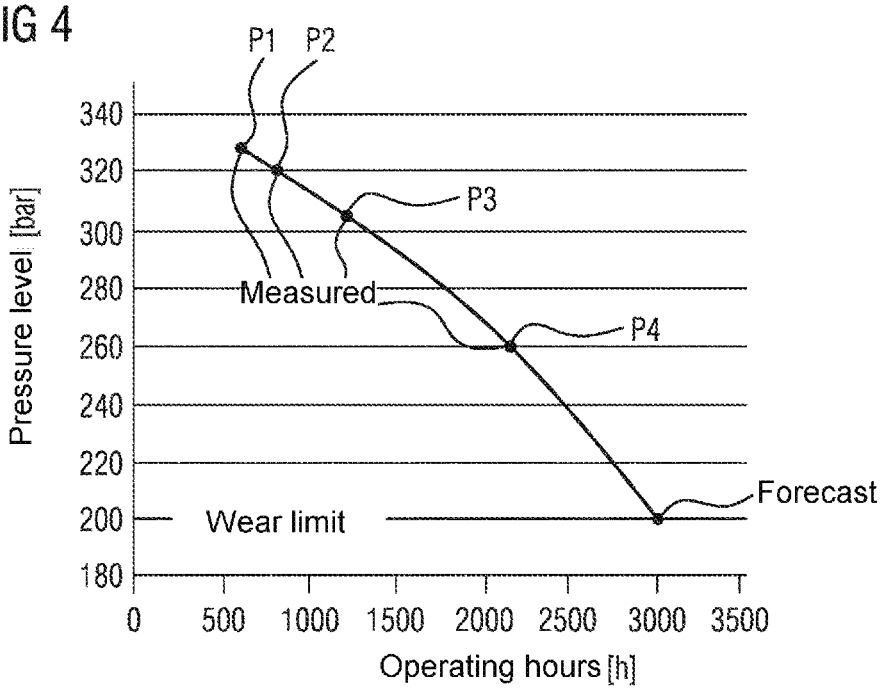
FIG. 4 shows a fourth diagram, for predicting the wear-related failure time of the pressure limiting valve of the high-pressure fuel pump of a motor vehicle.

This is illustrated in FIG. 4. This shows a fourth diagram, which may be used in predicting the wear-related failure time of the pressure limiting valve of the high-pressure fuel pump of a motor vehicle, instead of the second diagram shown in FIG. 2. In this fourth diagram, the pressure level is once again plotted toward the top in bar and the operating time of the pressure limiting valve is plotted toward the right in operating hours.

The pressure level denoted by P1 was determined after 700 operating hours. The pressure level denoted by P2 was determined after 900 operating hours. The pressure level denoted by P3 was determined after 1200 operating hours. The pressure level denoted by P4 was determined after 2100 operating hours. From the profile of the pressure levels determined it is possible, here too, to predict the time at which a wear-related failure of the pressure limiting valve may be expected. In the case of the illustrative embodiment illustrated in FIG. 4, this is likewise the case after 3000 operating hours.

By virtue of this prediction, the driver of the motor vehicle has the possibility of making provision for a repair or replacement of the pressure limiting valve or of the entire high-pressure fuel pump in good time before the predicted failure of the pressure limiting valve.

According to an advantageous embodiment which may be used in addition or alternatively to a prediction of the failure time of the pressure limiting valve of a high-pressure fuel pump of a motor vehicle, it is time segments at critical operating points that are taken into account. As has already been mentioned above, the pressure limiting valve may be opened both in an afterheating phase after the engine has been switched off and at operating points with a high load and engine speed. Consequently, the operating point range in which the pressure limiting valve may be opened is known. This opens up the possibility of counting the times in which the engine is operated at these operating points. There is also the possibility of counting individual load cycles, e.g. a high-pressure pump piston stroke. The frequency and the determined time profile make it possible, in turn, to predict the time when the wear limit will be reached by means of a trend analysis.

In this case, the trend algorithm may also include the frequency of the critical load points, for example, in order to adapt the prediction to the usage behavior which occurs in operation. Thus, the prediction will forecast an earlier failure of the pressure limiting valve for a driver who often operates the vehicle at critical load points than for a driver who operates the vehicle only infrequently at critical load points.

The above-described method is controlled by a control unit. A device for predicting the failure time of the pressure limiting valve of a high-pressure fuel pump of a motor vehicle consequently has a control unit which is designed to control a method as claimed.

The invention claimed is:

1. A method for predicting a failure time of a pressure limiting valve of a high-pressure fuel pump of a motor vehicle, the pressure limiting valve configured to open and discharge fuel from a high-pressure region to a low pressure-region, comprising the steps of:

measuring a characteristic parameter of the pressure limiting valve measured each time the motor vehicle has been switched off;

determining and storing a variable determined by using each characteristic parameter measured after each time the motor vehicle has been switched off, the variable being an aggregate of at least three previously calculated variables;

determining a time profile of variable determined from each characteristic parameter measured after each time the motor vehicle has been switched off, wherein the time profile is tracked against the number of operating hours of the pressure limiting valve;

predicting a future profile of the variable determined from each characteristic parameter based on the determined time profile of the pressure drop tracked against the number of operating hours of the pressure limiting valve; and comparing the predicted future profile of the variable determined from each characteristic parameter with a predetermined wear limiting value to predict a time at which the predicted future profile of the variable determined from each characteristic parameter reaches the predetermined wear limiting value.

2. The method of claim 1, further comprising the steps of providing the characteristic parameter to be pressure.

3. The method of claim 2, further comprising the steps of providing the variable determined from the measured pressure to be pressure drop.

4. The method of claim 3, determining the time profile further comprising the steps of determining the time profile of the pressure drop.

5. The method of claim 1, further comprising the steps of predicting the time at which the predicted future profile of the pressure drop reaches the predetermined wear limiting value.

6. The method of claim 5, further comprising the steps of providing the predicted time at which the predicted future profile of the pressure drop reaches the predetermined wear limiting value to be the failure time of the pressure limiting valve.

7. The method of claim 1, further comprising the steps of providing operating times in which the motor vehicle has been operated at critical operating points to predict the failure time of the pressure limiting valve.

8. The method of claim 1, further comprising the steps of:

providing a device for predicting a failure time of the pressure limiting valve of a high-pressure fuel pump of a motor vehicle, the device further comprising a control unit.

9. The method of claim 1, further comprising the steps of predicting the time at which the predicted future profile reaches the predetermined wear limiting value based upon comparing the predicted future profile with the predetermined wear limiting value.

10. A motor vehicle control unit for predicting a failure time of a pressure limiting valve of a high-pressure fuel pump of a motor vehicle, the pressure limiting valve configured to open and discharge fuel from a high-pressure region to a low pressure-region, the motor vehicle control unit configured to perform a method comprising the steps of:

measuring a characteristic parameter of the pressure limiting valve each time the motor vehicle has been switched off;

determining and storing a variable determined by using the characteristic parameter measured after each time the motor vehicle has been switched off, the variable being an aggregate of at least three previously calculated variables;

determining a time profile of the variable determined from the characteristic parameter measured after each time the motor vehicle has been switched off, wherein the time profile is tracked against the number of operating hours of the pressure limiting valve;

predicting a future profile of the variable determined from the characteristic parameter based on the determined time profile of the pressure drop tracked against the number of operating hours of the pressure limiting valve; and comparing the predicted future profile of the variable determined from the characteristic parameter with a predetermined wear limiting value and predicting a time at which the predicted future profile of the variable determined from the characteristic parameter reaches the predetermined wear limiting value based upon the comparison.

11. The motor vehicle control unit of claim 10, the characteristic parameter further comprising pressure at the pressure limiting valve.

12. The motor vehicle control unit of claim 11, wherein the the variable determined from the measured pressure is pressure drop.

13. The motor vehicle control unit of claim 12, wherein determining the time profile further comprises determining the time profile of the pressure drop.

14. The motor vehicle control unit of claim 11, wherein the predicted time at which the predicted future profile of the pressure drop reaches the predetermined wear limiting value is the failure time of the pressure limiting valve.

15. The motor vehicle control unit of claim 10, further comprising operating times in which the motor vehicle has been operated at critical operating points to predict the failure time of the pressure limiting valve.

16. The motor vehicle control unit of claim 10, the method further comprising the steps of predicting the time at which the predicted future profile of the variable determined from the characteristic parameter reaches the predetermined wear limiting value.

* * * * *